United States Patent [19]

Woolhiser et al.

[11] Patent Number: 4,962,598

[45] Date of Patent: Oct. 16, 1990

[54] APPARATUS FOR MOUNTING IMPLEMENTS ON VEHICLES

[76] Inventors: Harold G. Woolhiser, P.O. Box 4801, S. Huron, Standish; Victor L. Hoffman, 270 Whitefeather Rd., Pinconning, both of Mich. 48658

[21] Appl. No.: 203,321

[22] Filed: Jun. 7, 1988

[51] Int. Cl.[5] ..... E01H 5/04

[52] U.S. Cl. ..... 37/231; 37/236; 37/279; 37/117.5; 172/819

[58] Field of Search ..... 37/117.5, 266, 279, 37/236, 232, 231; 172/811, 817, 818, 819

[56] References Cited

U.S. PATENT DOCUMENTS

| | | | |
|---|---|---|---|
| 1,436,286 | 11/1922 | Ouradnik . | |
| 1,776,788 | 9/1930 | Gettelman | 37/232 |
| 1,791,942 | 2/1931 | Symonds | 37/279 |
| 1,957,103 | 5/1934 | Frink | 37/279 |
| 1,961,011 | 5/1934 | Pearson | 37/279 |
| 2,006,761 | 7/1935 | Frink | 37/232 |
| 2,317,680 | 4/1943 | Fitzpatrick | 37/232 |
| 2,565,337 | 8/1951 | Allan | 37/279 |
| 2,667,708 | 2/1954 | Gjesdahl . | |
| 2,991,566 | 7/1961 | Sumner et al. | 37/232 |
| 3,010,230 | 11/1961 | Zubko | 37/279 |
| 3,201,878 | 8/1965 | Markwardt . | |
| 3,307,275 | 3/1967 | Simi . | |
| 3,539,022 | 11/1970 | Berg | 172/819 |
| 4,058,173 | 11/1977 | Carson . | |
| 4,187,624 | 2/1980 | Blau . | |
| 4,304,056 | 12/1981 | Watson et al. . | |
| 4,304,057 | 12/1981 | Watson et al. . | |
| 4,320,589 | 3/1982 | Pelazza . | |
| 4,439,939 | 4/1984 | Blau . | |
| 4,590,694 | 5/1986 | Block . | |

FOREIGN PATENT DOCUMENTS

| | | | |
|---|---|---|---|
| 397604 | 1/1974 | U.S.S.R. | 172/819 |

*Primary Examiner*—Eugene H. Eickholt

*Attorney, Agent, or Firm*—Harness, Dickey & Pierce

[57] ABSTRACT

A lightweight snow plow apparatus for attachment to the front of a vehicle comprises an aluminum moldboard swivelly mounted in an easily removable manner on the ends of tubular telescopic side beams of an aluminum H-frame, the other ends of the side beams being removably pivoted to a pivot tube mounted on the frame of the vehicle. The side beams are telescopically moved to angle the moldboard by a rack and pinion mechanism housed in the side beams and in the cross beam of the H-frame and which is driven by an electric motor, connected to the electrical system of the vehicle, through a gear box that includes a slip clutch to prevent overloading. The H-frame and moldboard are lifted off the ground and lowered to the ground by an electric motor driven linear actuator, connected to the electrical system of the vehicle, which is pivoted to the cross beam of the H-frame and mounted on a bracket which is removably supported on the front bumper support of the vehicle.

20 Claims, 10 Drawing Sheets

APPARATUS FOR MOUNTING IMPLEMENTS ON VEHICLES

This invention relates to apparatus for the removable mounting of snow plow blades and other implements (such as gang mowers, vacuum cleaners, rotary brushes, etc.) on the front ends of vehicles whereby the vehicles can be used to push the implements.

It is a principal purpose of the invention to provide an apparatus of this type which is of a simplified construction, very light in weight, and electrically operated to provide power lift and power angling. These features enable it to be easily mounted on and dismounted from pick-up trucks, or other lightweight vehicles, and to be operated by the vehicle electrical system.

Apparatus according to a preferred form of the invention includes a novel H-shaped, horizontally extending, implement support frame. The two sides of the H-frame are preferably telescopic hollow beams that are pivoted at their rear ends to the front end of the vehicle frame. The front ends of the two sides of the H-frame are swivelly connected to the back of the implement, this being a moldboard or plow blade in the case of a snow plow. Power lift and lowering of the blade are achieved by pivoting of the H-frame on the vehicle frame. Energy for this is provided by an electrically driven linear actuator which is pivoted at its lower end to the midpoint of the cross beam of the H-frame and at its upper end to a lift bracket that is removably mounted on the front end of the vehicle.

In the preferred form of the invention as applied to a snow plow, power angling of the blade in either direction is achieved by an electric motor which drives a gear assembly mounted on the cross beam. This turns a rotary shaft housed inside of the cross beam. Pinions inside the side beams of the H-frame are fixed to the opposite ends of the rotary shaft. They mesh with the teeth of rack bars affixed to the telescopic front ends of the H-frame sides. The rack bar on one side is above the pinion while the rack bar on the other side is below the pinion. Rotation of the shaft by the motor therefore moves each front end an equal amount but in opposite longitudinal directions to produce angling of the blade. Overload release means are preferably provided in the form of slip clutch means inside of the gear assembly. This protects the rotary shaft from high stress due to heavy load on the implement or due to motor load if the telescopic ends are at full stroke.

Apparatus according to the preferred form of the invention also allows trip action of a plow blade. To achieve this, a novel mounting of the blade on the front ends of the telescopic H-frame sides permits the blade to pivot a limited amount on a horizontal axis. Such pivoting, however, is against the resistance of a horizontal torsion bar which is twisted during tripping of the blade. Thus, after the blade rides over the obstacle, energy stored in the torsion bar will return it to its normal position.

In accordance with the preferred form of the apparatus, the various connections are such that they can be made quickly and easily. Thus, the pivotal mounting of the H-frame comprises simple latch means which may be removed to allow the H-frame to be put in place at opposite ends of a pivot support tube which extends horizontally and transversely across the front end of the vehicle. The tube is removably affixed to the longitudinal side frame members of the vehicle chassis by support plates which can be attached by bolts to the chassis. Similarly, the lift bracket mounting is of simple construction that may be clamped in place over the vehicle bumper and preferably attached with the same fastening means used to secure the bumper to the vehicle frame. Further, the plow blade itself (or other implement) is quickly connected and disconnected from the ends of the telescopic sides of the H-frame by simply removing or inserting vertical pins extending through mating apertures in connection parts affixed to the back of the blade and to the ends of the telescopic sides.

The snow plow blade or mold board itself is of a novel shape which is designed to create rollover of the snow and inhibit snow blowback over the top of the blade toward the vehicle. The blade preferably has a wear strip attached to its bottom end which may be removed and replaced in order to provide for wear or to provide a different type of cutting edge.

The various parts of the H-frame and the moldboard are preferably constructed of aluminum so that they are strong yet very light in weight, promoting vehicle fuel efficiency and ease of handling. The apparatus is low in height so that it does not obstruct the vision of the driver of the vehicle. Because of the light weight, it may nevertheless be elevated and the vehicle driven with the blade in elevated postion. However, because of the ease of detachment of the blade, it may also be easily removed. The apparatus is also such as to provide a relatively high ground clearance, particularly when the blade and H-frame have been removed.

Because of the light weight and the simplified connections, the device may be used by nonprofessionals as well as professionals. Also because of the manner of connection to the vehicle and the optimum load distribution provided by the H-frame, it can be used on two-wheel drive and smaller type vehicles. Nevertheless, the device is durable, dependable and versatile and the design permits it to be compatible with a wide variety of vehicles.

The various mounting pins including the attachment of the pivot mounting for the H-frame to the vehicle, the connection of the H-frame to the pivot mounting, and the connection of the plow blade to the H-frame are all easily accessible for installation and removal. The connections are also of a simple nature so that they can be easily made.

Since the motor for operating the lift mechanism and the motor for operating the power angling are connected into the electrical system of the vehicle, they can be easily operated by a hand control located within the driver's compartment of the vehicle.

Various other objects, features and advantages of the invention will appear in connection with the detailed description.

DETAILED DESCRIPTION OF PREFERRED EMBODIMENTS

Figure 1:
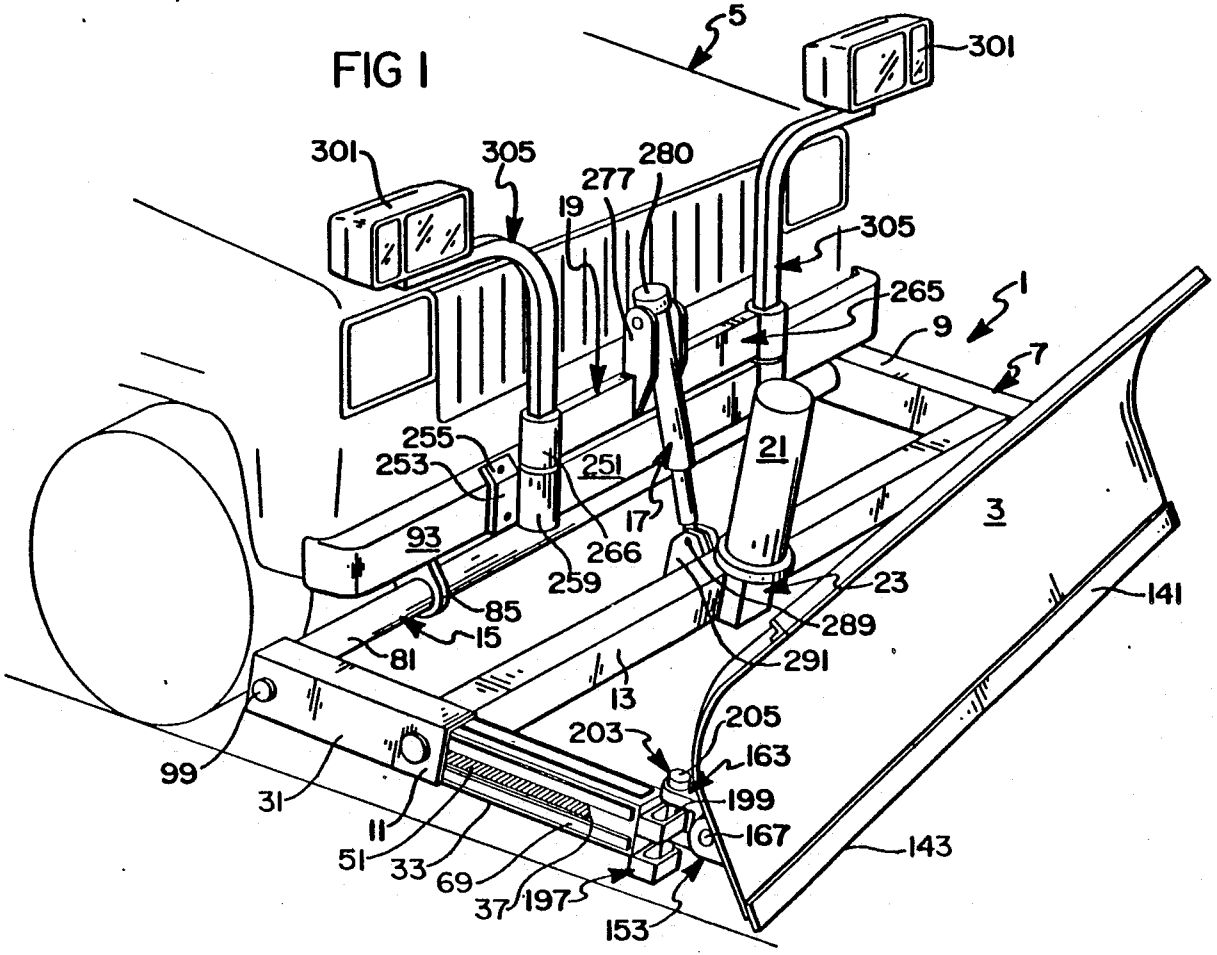
FIG. 1 is a perspective view of the apparatus according to the invention mounted on the front end of a vehicle and showing a snow plow blade in the lowered or plowing position.

Referring first to FIGS. 1 to 4, apparatus 1 in accordance with the invention is shown in use for attaching a snow plow blade 3 to the front end of a vehicle 5. Apparatus 1 includes an H-frame 7 that has a left side member 9 and a right side member 11, these side members extending horizontally parallel to each other and to the length of the vehicle 5. The side members 9 and 11 are interconnected by a cross member 13.

The top ends of the H-frame side members 9 and 11 (i.e., their rear ends with respect to the vehicle) are pivotally mounted on the front end of the vehicle 5 by means of a pivot bar assembly 15. The pivot bar assembly 15 permits the H-frame 7 and therefore the plow blade 3 carried by the H-frame to be pivoted in an upward direction to lift the blade 3 off the ground. Power for lifting is provided by a linear actuator mechanism 17. The lower end of the mechanism 17 is connected to a midportion of the cross member 13 of the H-frame. The upper end of the mechanism 17 is pivotally secured to a lift mounting bracket means 19. The bracket means 19 is secured preferably to the front bumper support frame members for the vehicle 5. The bottom ends (that is the front ends with respect to the vehicle) of the H-frame side members 9 and 11 are swivelly connected to the plow blade 3. These portions of the side frame are extendable or telescopic with respect to the rest of the side beams. Thus, by longitudinally moving one side member differently than the other, the blade 3 can be put in an angled position wherein it is no longer parallel to the front end of the vehicle. Power for angling of the blade 3 is supplied by an electric motor 21 which is mounted on top of a gear box 23 which forms a central portion of the cross beam 13. The gear box drives a rack and pinion mechanism that is housed within the H-frame 7 and it is this which provides telescopic movement of side members 9 and 11 in opposite longitudinal directions so as to achieve angling in the manner mentioned above.

Referring to FIGS. 1–6, the novel H-frame 7 has left and right side members 9 and 11 that are substantially identical. Each includes an outer tubular beam 31 and an inner tubular beam 33 which telescopes inside of the outer beam. The tubular beams 31 and 33 are preferably extruded in rectangular cross section to provide strength and rigidity and formed of a lightweight metal, such as aluminum, to optimize strength, lightness, and cost.

Figure 6:
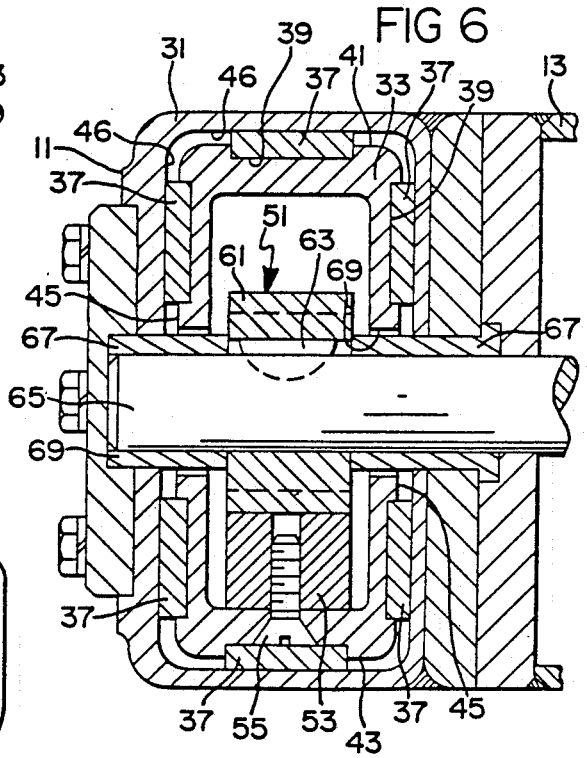
FIG. 6 is a cross section taken along the line 6—6 of FIG. 5.

Bearing means 35 are preferably used to facilitate telescopic movement of each inner beam 33 inside of its outer beam 31. This is shown in the form of six elongated rectangularly shaped wear strips 37 of suitable metal that fit in recesses 39 formed in the outer faces of each inner beam 33 (FIG. 6). They are suitably secured to the inner beam 33, as by countersunk screws (not shown). As seen best in FIG. 6, the lengths (or long sides) of the rectangular cross sections of the beams 31 and 33 are in vertical planes and the widths (or short sides) of the cross sections are in horizontal planes. Thus, the top and bottom walls 41 and 43 of the inner beams 33 each have a wear strip 37 and the two vertical side walls 45 each have a pair of wear strips 37. The parts are dimensioned so that the wear strips fit snugly in and slide smoothly on the inner faces or walls 46 of the outer beams 31.

Telescopic movement of the inner beams 33 inside of the outer beams 31 is achieved by a rack and pinion means 51. This comprises an elongated rack bar 53 which in the case of right side member 11 (FIG. 6) is affixed inside of beam 33 to the bottom wall 43, as by countersunk screws 55, and extends along the length of the beam 33. In the case of the left side member 9, the rack bar is affixed inside of the inner beam to the top wall 41, i.é., just the reverse of the construction shown in FIG. 6.

As shown in FIG. 6, a pinion 61 meshes with the teeth of the rack bar 53. The pinion 61 is secured, as by key 63, to the right end of a cross shaft 65. There is also a pinion 61 (not shown) at the left end of cross shaft 65. The shaft 65 is supported by bushings 67 carried by the vertical side walls of the outer beams 31. The bushings 67 extend through elongated slots 69 in the vertical sidewalls of the inner beams 33 whereby the inner beams 33 can move longitudinally when actuated by the rack and pinion means 51.

The cross shaft 65 is housed inside of the elongated cross beam 13 which, like beams 31 and 33, is preferably formed in a rectangular cross section of extruded aluminum. Though not shown in the drawings, the left end of the cross shaft 65 is mounted in the left side member 9 in the same manner as illustrated for right side member 11. It carries a pinion 61 (not shown) to operatively engage a rack bar mounted on the top wall of the inner beam as mentioned above.

Since the pinions 61 on cross shaft 65 engage a top mounted rack 53 (not shown) in the left member 9 and a bottom mounted rack 53 in the right member 11 (FIG. 6), rotation of the shaft 65 produces equal but opposite longitudinal, fore and aft, movement of the left and right inner beams 33. The extent of this movement is controlled by the lengths of slots 69, since further movement will be blocked when a bushing 67 reaches the end of a slot. This equal and opposite movement of the telescopic side members 9 and 11 can be used to produce angling of the blade 3, as will be described hereinafter.

The wear strips, rack mechanism, and internal parts are protected from foreign matter by flexible bellows members 75 (FIG. 3) which have their rear ends affixed to the outer beams and their front ends affixed to the inner beams.

Figure 8:
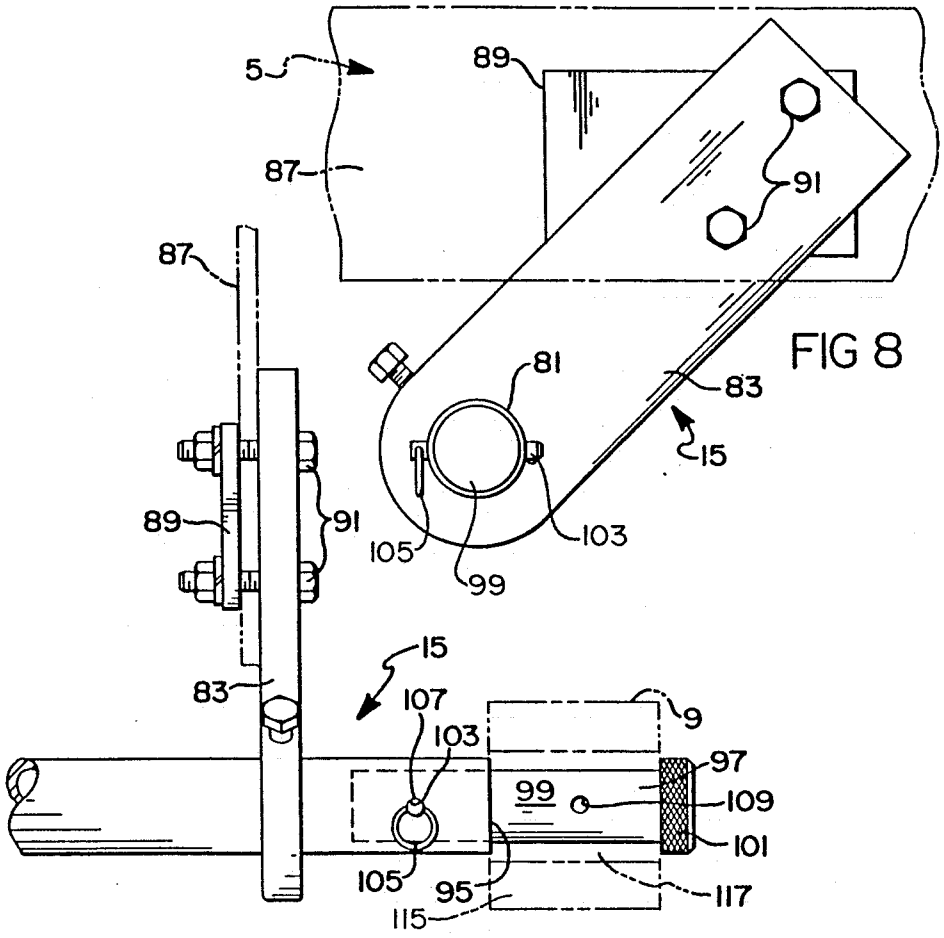
FIG. 8 is a side view of the mechanism of FIG. 7.
Figure 7:
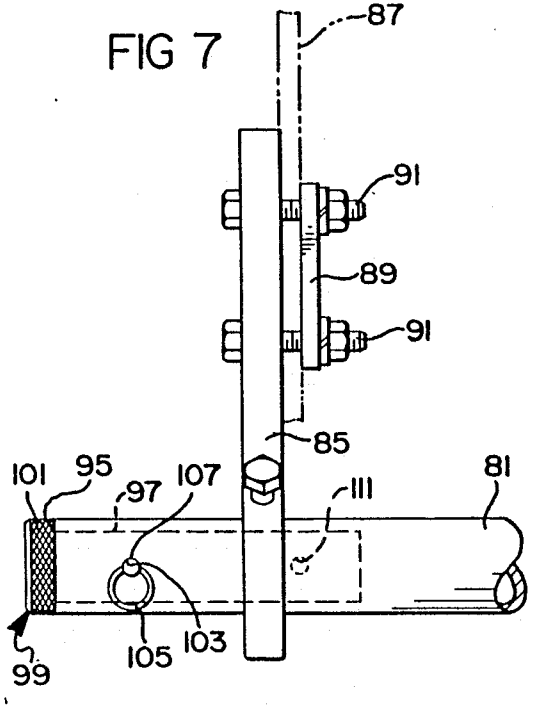
FIG. 7 is a broken away top elevation of the pivotal mounting bar assembly for connecting the H-frame to the vehicle frame.

The pivot bar assembly 15 shown in FIGS. 7–8 (as well as FIGS. 1–4) pivotally secures the rear end of the H-frame 7 to the chassis or frame of vehicle 5. The assembly 15 comprises an outer tube 81 of round cross section. Rigidly affixed to the tube and extending upwardly and to the rear from it (FIG. 4) are left and right frame bracket plates 83 and 85. These are located to fit respectively outboard of left and right side longitudinal frame members 87 of the vehicle 5. Each bracket plate 83/85 has a back-up plate 89 to fit against the inboard or inside faces of the vehicle frame members 87. Bolt holes in the plates 83, 85, and 89 receive a pair of bolt and nut assemblies 91 for each side and appropriate bolt holes are drilled in the vehicle frame members 87 to permit passage of the four bolts, two on each side. When the bolt assemblies 91 are tightened up, the frame brackets 83 and 85 and their respective back-up plates will be tightly (but removably) affixed and clamped to the frame members 87 and therefore to the underside of the forward end of the vehicle 5. The particular location and shape of the frame brackets 83 and 85 and back-up plates 89 may have to be varied to enable the pivot assembly 15 to be attached to a specific vehicle.

Figure 2:
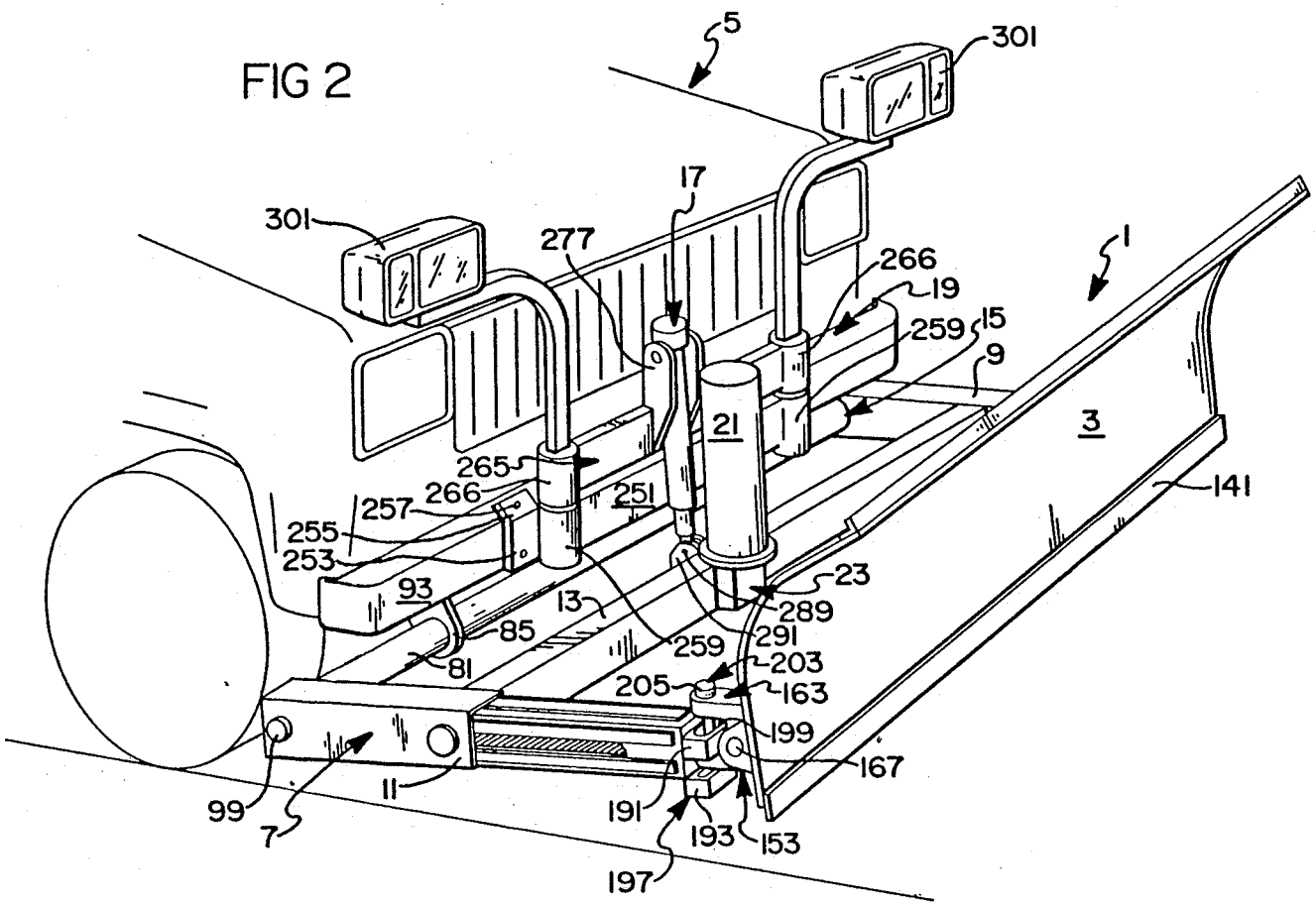
FIG. 2 is a view similar to that of FIG. 1 but showing the blade in the elevated or carried position.
Figure 3:
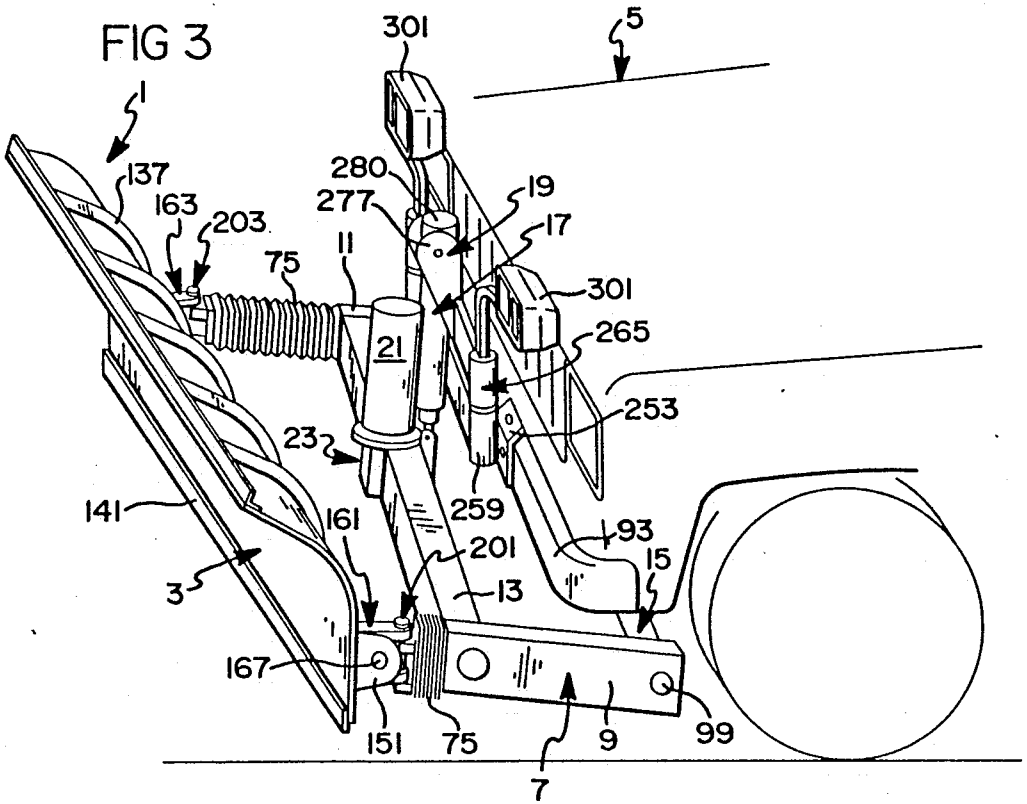
FIG. 3 is a view similar to FIGS. 1 and 2 but it is taken from the opposite side of the vehicle on the apparatus and shows the blade in an angled and elevated position.

When the assembly 15 is clamped to the vehicle 5 as just described, the main mounting tube 81 will be horizontal and located close to the bottom of the front bumper 93 or front end of the vehicle, as seen best in FIGS. 1–3. In this position, the tube 81 is parallel to the ground but relatively far above it to provide high ground clearance.

The open opposite ends 95 of the tube slidably receive the round shafts 97 of quick release hinge pins 99, the pins 99 having enlarged knurled heads 101 on their outer ends to serve as hand grips. The hinge pins 99 have an inoperative, stored position shown at the left of FIG. 7 and an operative position shown at the right of FIG. 7. In each position, each hinge pin 99 is held longitudinally in that position by a transverse keeper pin 103 with a pull ring 105 on its outside end. The outer tube 81 has aligned holes 107 to receive the keeper pins 103, the holes being located on vertical axes adjacent opposite ends of the tube 81. The two hinge pins 99 each have an outer hole 109 through its shaft 97 adapted to register with tube holes 107 and to receive the keeper pins 103. When keeper pins 103 extend through hinge pin holes 109, the hinge pins will be in the stowed, inoperative position shown at the left of FIG. 7. The hinge pins 99 each have an inner hole 111 through its shaft 97 that is also adapted to register with tube holes 107. When keeper pins 103 extend through holes 111, the hinge pins will be in the extended operative position shown at the right of FIG. 7.

Figure 4:
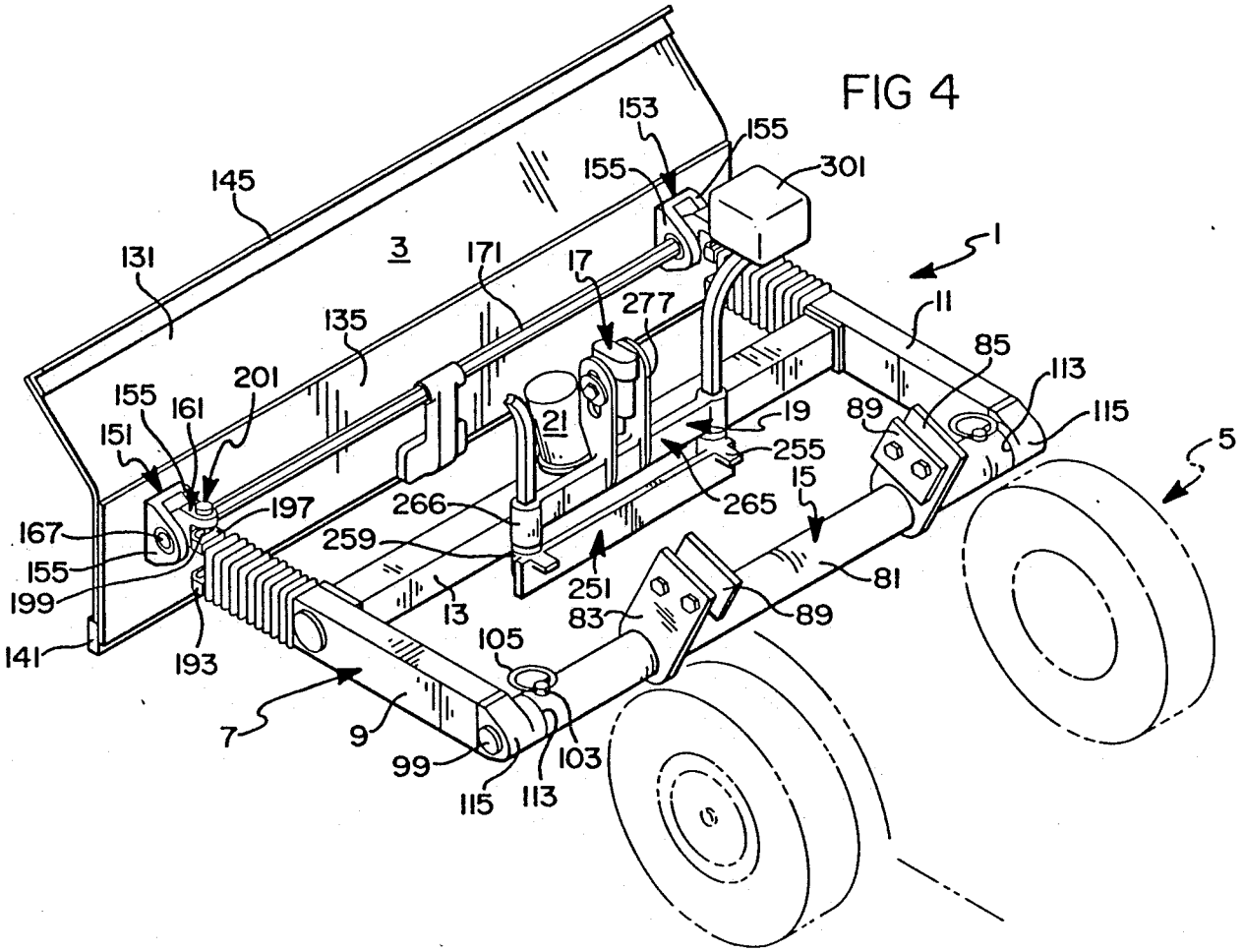
FIG. 4 is a somewhat diagramatic (some parts omitted and/or broken away) perspective view of the structure of FIGS. 1–3 looking at the apparatus from the rear or from substantially the driver's position.
Figure 5:
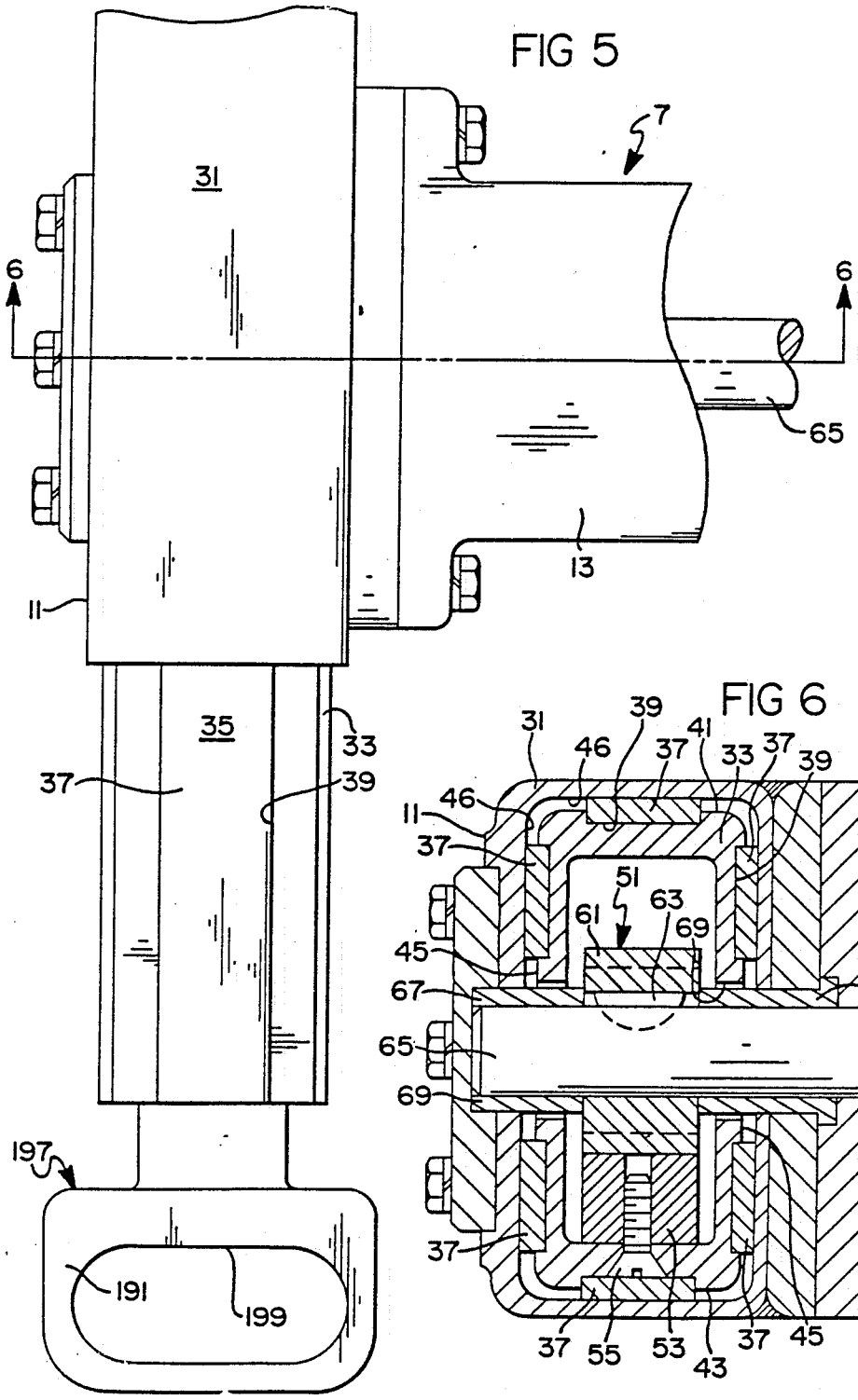
FIG. 5 is an enlarged plan view of a portion of the left side beam of the H-frame and also showing a part of the cross beam.

The opposite end faces 95 of the mounting tube 81 are spaced apart the same distance as the spacing between the inner faces 113 of the rear ends 115 of the left and right side members 9 and 11 (FIG. 4). The rear ends 115 are apertured and preferably provided with transverse bushings 117 which when aligned with the axis of tube 81 are adapted to receive the hinge pins 99. Thus, to mount the H-frame 7 (and apparatus 1) on the vehicle 5, the hinge pins 99 are removed from the opposite ends of tube 81, the rear ends 115 of the H-frame are aligned with the tube 81, the hinge pins 99 are grasped by their knurled heads 101 and inserted through the ends 115 (and bushings 117) into the tubes 81 until their holes 111 register with vertical tube holes 107, whereupon the keeper pins 103 are pushed down through the vertically aligned holes to hold the hinge pins 99 stationary on the tube 81. The extending portions of hinge pin shanks 97 then are in position to serve as pivot or hinge means for up and down movement of the H-frame 7. They also serve to transmit loads from the H-frame into the tube 81 and then by way of brackets 83 and 85 into the frame members 87 of the vehicle 5.

When it is desired to disconnect the H-frame 7 and attached parts from the vehicle 5, the hinge pins 99 can be manually removed, the H-frame 7 pulled away from the vehicle, and then the hinge pins 99 reinserted in the ends of tube 81 to the stowed positions as shown at the left of FIG. 7. The hinge pins 99 and keeper pins 103 therefore act as a simple, quick release latch means for connecting and disconnecting the implement 1 to or from the vehicle.

Figure 10:
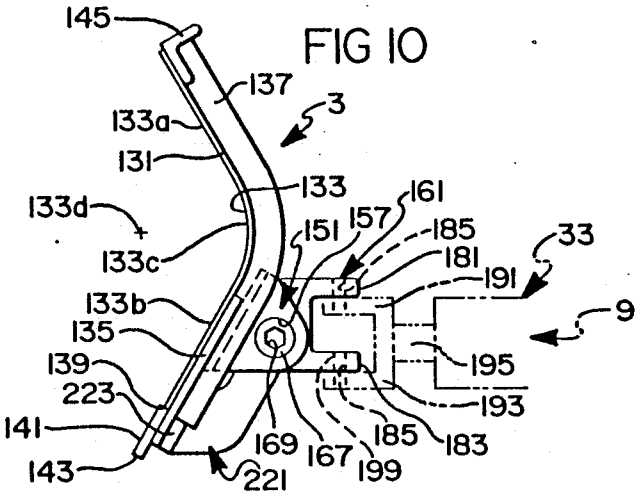
FIG. 10 is a side elevation taken from the left of FIG. 9.
Figure 9:
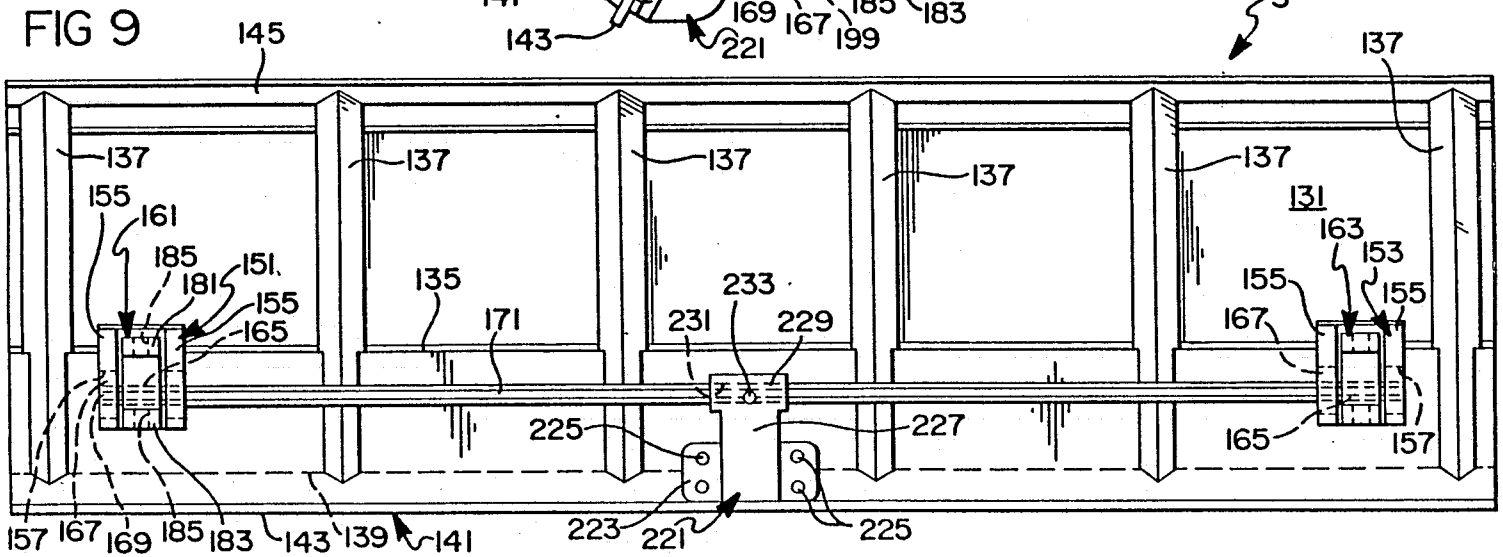
FIG. 9 is a rear elevation of the snow plow blade.

Turning now to the moldboard 3 and its attachment to the H-frame 7 as seen best in FIGS. 9–10 together with FIGS. 1–6, the moldboard or plow blade 3 comprises an elongated transverse metal sheet 131, preferably aluminum, that is rectangular in front and rear elevation but curved in cross section (FIG. 10) so that it has a concave front or operative face 133. The lightweight aluminum blade 131 is reinforced on the lower portion of its rear side by a flat aluminum backup plate 135, that extends from the left end to the right end of the blade, and by a series of transversely spaced curved aluminum ribs 137 that extend from the top of the blade to the bottom, as seen best in FIG. 9. The plate 135 extends below the bottom edge 139 of the blade sheet 131. Removably attached to the front face of the plate 135 is a flat, rectangular wear strip 141. This extends the full width of the blade and its top edge engages the bottom edge 139 while its bottom edge 143 will normally rest on and slide along the ground during operation of the equipment. The top of the sheet 131 is preferably reinforced by an angle bar 145 secured to the back of sheet and extending across its full width as seen in FIG. 9.

The particular cross sectional shape of the blade 131, as seen best in FIG. 10, is believed to be desirable for optimum snow movement. The face 133 comprises upper and lower flat sections **133*a* and 133*b*, respectively, and they are tangent to and diverge outwardly from a curved center section 133*c* that is formed on a 6 inch radius from a center 133*d* that is located equal distances from the top and bottom edges of the sheet 131. The center section subtends an arc of 30 degrees with respect to center 133*d*, the arc being horizontally bisected, i.e., 15 degrees of the arc being on opposite sides of a horizontal radius, parallel to the ground, from center 133*d***.

As previously indicated, the left and right sides of the moldboard 3 are swivelly connected to the left and right sides 9 and 11, respectively, of the H-frame 7. For this purpose left and right side clevis members 151 and 153, respectively, have backs that are affixed to the backup plate 135 adjacent to but inwardly of its left and right sides, as seen best in FIG. 9. The clevis members 151 and 153 are spaced apart the same distance as sides 9 and 11 of the H-frame, to which they are connected as presently described. The horizontally spaced vertical sides 155 of each clevis have circular holes 157 through them which are coaxial and located on a horizontal axis parallel to the bottom edge 143 of the moldboard 3. Left and right trunnion members 161 and 163 fit between the sides 155 of the left and right clevis members 151 and 153, respectively. Each trunnion member has a hexagon shaped transverse aperture 165 extending through it and each clevis side hole 157 has a bushing 167 fitted in it for relative angular or rotary movement. Each bushing 167 has a hexagon shaped aperture 169 through it of the same size as, and alignable with, the apertures 165 in the trunnions 161 and 163. A long hexagon shaped torsion bar 171 extends through hexagon shaped apertures 165 in the trunnions 161 and 163 whereby the trunnions and the bar 171 are fixed together for joint angular movement about the axis of the bar 171. The bar 171 also extends through the hexagon shaped apertures 169 in the bushings 167 whereby relative angular movement between each clevis and its trunnion can take place. Thus, the moldboard 3 can pivot relative to trunnions 161 and 163 on bushings 167 about the horizontal axis of circular holes 157 which is also the axis of the hexagon shaped apertures 169 and 165 and the torsion bar 171.

Each trunnion 161 and 163 has upper and lower horizontal arms 181 and 183 which are parallel but vertically spaced and contain vertically aligned round holes 185 through them. The trunnion arms interfit loosely with upper and lower horizontal arms 191 and 193 on left and right clevis members 195 and 197, respectively, that are affixed to or form the front ends of the telescopic inner tubes 33 of the left and right sides 9 and 11, respectively, of the H-frame 7. The upper and lower arms 191 and 193 have vertically aligned slots 199 (FIG. 5) through them. The width of the slots 199 is substantially the same as the diameter of the round holes 185 but the length of the slots 199 is substantially greater than such width; preferably about 2½ times greater than the width. Left and right hand vertical swivel pins 201 and 203 with diameters slip fitting easily inside of holes 185 are dropped through aligned holes 185 and slots 199 when it is desired to swivelly mount and connect the moldboard 3 to the H-frame 7. The top ends 205 of the swivel pins are enlarged to serve as hand grips for manual insertion and removal of the pins and to seat the pins on the upper faces of the upper trunnion arms 181.

The swivel pins 201 and 203 together with the interfitting upper and lower arms 181 and 183 of the trunnions 161 and 163 and upper and lower arms 191 and 193 of clevis members 195 and 197 flexibly hold the trunnions and clevis members together against relative movement in a vertical direction, i.e., the trunnions remain as longitudinally aligned extensions of the members 195 and 197 and therefore of the sides 9 and 11. However, the torsion bar 171 and its connections permit trip action motion of the moldboard blade 131 in the event its face 133 encounters an obstacle (such as a curb) during forward motion of the apparatus 1. In such case the blade 131 pivots on bushings 167 around the axis of bushings 167 and the torsion bar 171. The ends of the torsion bar, however, are held substantially fixed against angular movement by virtue of their keyed or splined connections to the trunnions 161 and 163 through the hexagon apertures 165. The torsion bar 171 is twisted to permit rearward trip action of the bottom part of the blade 131 by means of a torque arm bracket 221 which has a bottom pad 223 affixed, as by fasteners 225, to a mid-portion of the back of plate 135. A torque arm 227 extends upwardly from the pad 223 and has an enlarged upper portion 229 with a hexagon shaped aperture 231 through it. The bar 171 fits the aperture 231 and extends through it, a set screw 233 in portion 229 being shown to thread against the bar 171 and hold it tightly in place in the aperture 231. As viewed in FIG. 10, when the blade 131 is moving to the left and encounters an obstacle on the ground, such as a curb, it can pivot in a counter clockwise direction on the outer surface of bushings 167 carrying with it the pad 223 of the torque arm 221. The torsion bar 171 is on the axis of the bushing 167 and its opposite ends are fixed against angular movement as mentioned above. Thus, as the pad 223 moves to the rear the arm 227 acting through aperture 231 will apply torque to the bar 171 and twist it elastically. After the blade 131 has passed over the obstacle, the elastic energy stored in the twisted bar 171 will force the pad to move in a clockwise direction to pivot the blade 131 back to its original, operative position.

Figures 11, 12:
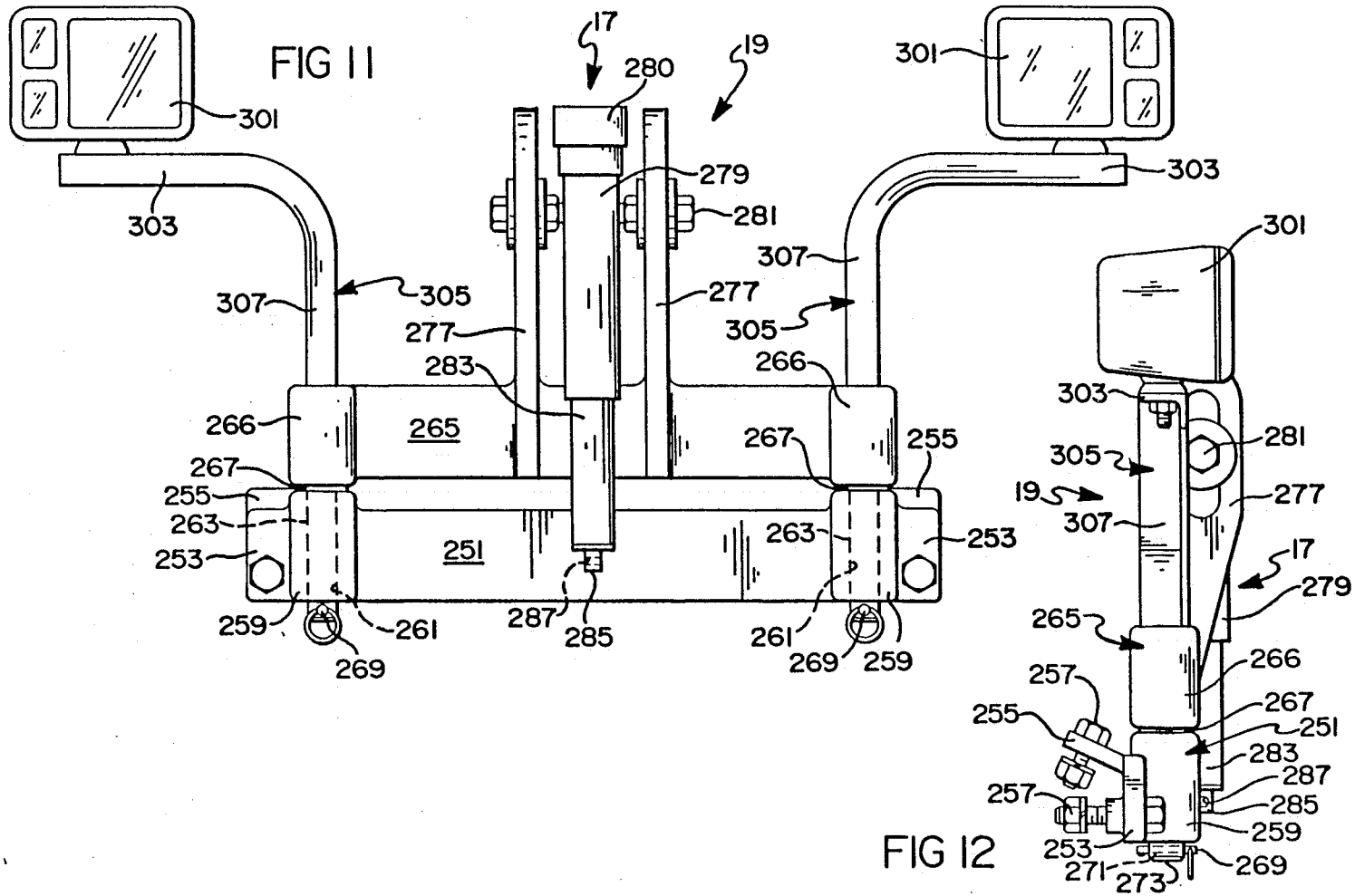
FIG. 11 is a front elevation of the lift bracket assembly including the linear actuator and also including the snow plow headlights.
FIG. 12 is a side elevation taken from the left of FIG. 11.

As previously indicated, lifting and lowering of the H-frame 7 is under the control of a linear actuator 17 which is pivoted at its upper end to a lift mounting bracket means 19 that is shown best in FIGS. 11–12 as well as FIGS. 1–4. The bracket means 19 includes a lower mounting bracket member 251 that is removably affixed to the front of the vehicle 5, preferably to the front bumper 93 and/or the bumper support members (not shown) on the vehicle 5. The member 251 is generally rectangular in configuration and has flanges 253 at each end, each having top portions 255 that are upwardly and rearwardly inclined so as to fit over the top edge of the bumper 93 (e.g., see FIG. 1) when the member 251 is bolted to the vehicle 5. Bolt and nut assemblies 257 extending through suitable openings in the flanges 253 may be used to removably affix the member 251 to the vehicle 5.

The member 251 has two enlarged portions 259, these being adjacent the side flanges 253. Each portion 259 has a vertical aperture 261 extending through it to slidably receive support legs 263 that are integral with and which extend from the bottom of a floating lift bracket member 265 that forms a part of the bracket means 19. The member 265, like bracket member 251, is generally rectangular in shape and it has enlarged end portions 266 with flat bottom pads 267 that seat on the flat tops of the enlarged portions 259. The member 265 is selectively held in the seated and supported position on bracket member 251 by keeper pins 269 that can be manually inserted through or removed from transverse openings 271 in bottom portions 273 of the legs 263.

The upper bracket member 265 has a pair of centrally located, transversely separated, vertically extending, rigid arms 277. An upper and outer portion 279 of the linear actuator 17 (available on the open market, e.g., "Performance Pak" linear actuators from Saginaw Steering Gear Division of General Motors Corporation) below its electric operating motor 280 is pivotally attached to upper portions of the arms 277 by transverse pivot means 281. The telescopic inner and lower portion 283 of the actuator 17 has a bottom portion 285 with a transverse opening 287 (FIG. 11) whereby it may be attached by transverse pivot means 289 between and to a pair of upstanding arms 291 that are rigid with the cross beam 13 of the support frame 7. Thus, when the motor 280 of the linear actuator is actuated to lift it will retract the inner tube 283 which will pull up on the cross beam arms 291 while the outer tube 279 will push down on the lift bracket arms 277 transferring the lift load through pads 267 into the mounting bracket 251 and into the vehicle 5.

If desired, snow plow headlights 301 may be mounted on the removable bracket 265. This is conventiently accomplished by securing them to the top, horizontal portions 303 of right angle rods 305, the vertical portions 307 of which are rigid with the enlarged end portions 266 of the bracket 265. Thus, when the pivot assembly 289 is removed to detach the linear actuator from cross beam arms 291 and the keeper pins 269 are removed, the headlights 301 along with the linear actuator 17 may be removed with bracket 265 from the vehicle. (It is to be understood that this would also entail disconnection of electrical wiring, not shown, to the headlights and to the motor 280.)

Figure 14:
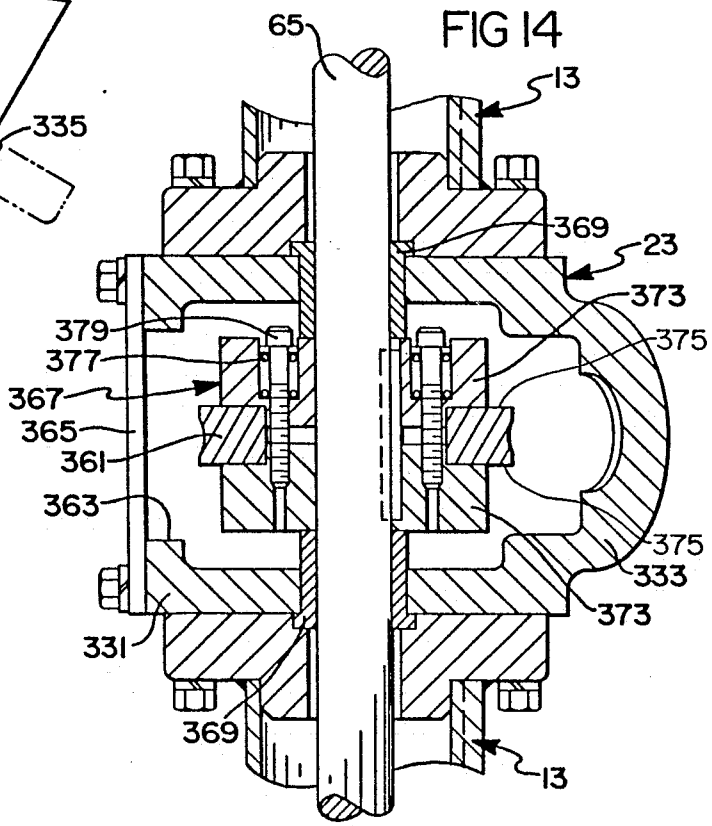
FIG. 14 is a horizontal cross-section taken through the gear assembly of FIG. 13.
Figure 13:
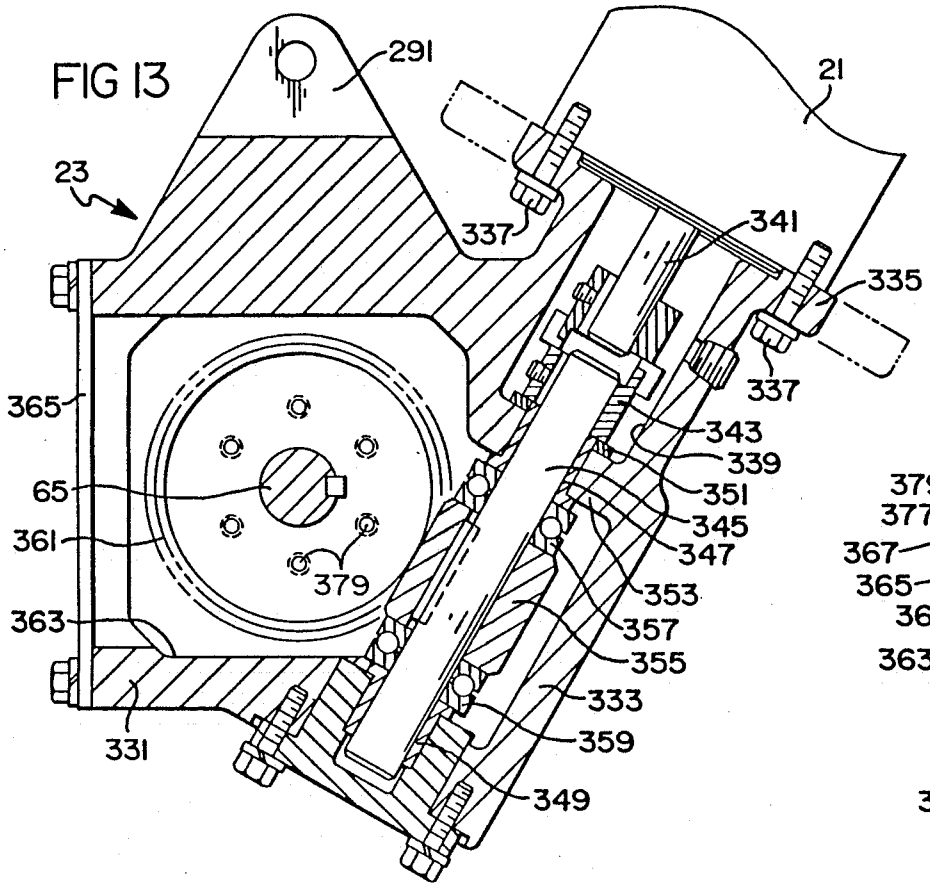
FIG. 13 is a vertical cross-section taken through the gear assembly and showing the motor for power angling partly broken away.

As previously indicated, power angling of the moldboard is obtained from an electric motor 21 operating through a gear assembly 23 on cross beam 13 to rotate cross shaft 65 that actuates the rack and pinion mechanism 51 to telescopically move the side members 9 and 11 in equal but opposite directions. The gear box 23 preferably includes a slip clutch means as illustrated in FIGS. 13 and 14. The gear assembly 23 includes a housing 331 that is rigidly integral with the cross beam 13 of the H-frame 7 and located, preferably, at its midportion. The linear actuator pivot arms 291 may be formed as a part of the housing 331 (FIG. 13).

The housing 331 has a front inclined portion 333 with a top inclined pad portion 335 to serve as a seat for the motor 21 which is bolted to the pad 335 as by bolts 337. The inclined portion 333 has an internal aperture 339 that is shaped to receive various internal members as illustrated in FIG. 13. Thus, the shaft 341 of motor 21 extends into aperture 339 where it is operatively connected by a coupling 343 to the upper end of a drive shaft 345. The shaft 345 rotates in upper and lower bushings 347 and 349 which are seated in appropriate portions of aperture 339. A thrust washer 351 is positioned between the coupling 343 and the interior wall 353 through which the upper bushing 347 extends. A worm gear 355 is keyed to the drive shaft 345 between upper and lower thrust type ball bearing sets 357 and 359. The worm gear 355 engages the teeth of a worm wheel 361 which is in a large aperture 363 formed in the housing 331 and closed by cover plate 365. The worm wheel 361 drives a slip clutch means 367 which in turn drives the cross shaft 65, shaft 65 being rotatably supported in bushings 369 in the walls of the housing 331.

The slip clutch means 367 comprises a pair of clutch plates 373 that are each keyed to the cross shaft 65 so that the plates and the shaft rotate together. Each plate 373 has a radial face that frictionally engages a radial face 375 of the worm wheel 361. The plates 373 are resiliently held against the radial faces 375 by springs 377 which are compressed by bolts 379 that clamp the plates toward each other against the radial faces 375 with a pressure that can be adjusted by adjusting the compression of the springs 377 with the bolts 379. In normal operation friction between the plates and the worm wheel will connect them together for the transfer of power to the cross shaft 65. However, if excessive loads are encountered or if an inner beam 33 is fully extended, slippage will occur on faces 375 to protect the shaft 65 and other parts.

In operation, the motor 21 can be actuated by the driver of vehicle 5 to set the blade 3 at the desired angle. The motor 21 drives the gear assembly 23 with slip clutch means 367 and this rotates the transverse shaft 65 inside of cross beam 13 of the H-frame 7. Pinions 61 at the opposite ends of the cross shaft 65 drive the upper rack bar in left side beam in one direction and the lower rack bar 53 in the right side beam 11 an equal amount in the opposite direction. This moves one of the clevis members 195 and 197, at the front ends of the side beams 9 and 11, to the front and the other to the rear. The vertical swivel pins 201 and 203 carried by trunnions 161 and 163 at the left and right ends of the blade 3 permit the blade 3 to pivot relative to the clevis members 195 and 197 with the transverse component of angling being accommodated by the slots 199 in the clevis members through which the pins 201 and 203 extend. If the motor 21 is not deactivated in time by the vehicle driver, the shaft 65 support bushings 67 will contact one end or another of the longitudianl slots 69 in the inner beams 33 to prevent further longitudinal movement. At this point one or both of the rack bars 53 is fixed in position and this will prevent rotation of its pinion 61 and therefore of the shaft 65 and the clutch plates 373. If the motor 21 is still activated, the torque which it applies to the worm wheel 361 will be dissipated in slippage at the engaging faces 375 between the worm wheel and the clutch plates.

In lifting or lowering the blade, the driver of the vehicle 5 actuates the linear actuator motor 280. The top end of the linear actuator 17 is pivotally supported on arms 277 of lift bracket 265. The bottom end of the actuator 17 is pivotally attached at 289 to flanges 291 that are rigid with cross beam 13 so that it carries some of the weight of the H-frame 7 when the bottom edge 143 of wear strip 141 is off the ground. This produces a down load on the bracket member 265 that is transmitted into lower bracket member 251 which in turn transfers it into the vehicle frame on which it is mounted. The rest of the weight of the H-frame and blade 3 is carried by hinge pins 99 which pivotally connect the rear ends 115 of the side beams 9 and 11 to the pivot tube 81 whereby such weight is transferred by tube 81 through brackets 83 and 85 into vehicle frame members 87.

Forward or backward movement of the vehicle 5 moves the tube 81 in the same direction and this is transmitted through hinge pins 99 into the H-frame side beams 9 and 11. The rack mechanism 51 fixes the telescopic length of each side beam so that such forward or backward movement is transmitted by the walls of slots 199 in the upper and lower arms 191 and 193 of the clevis members 195 and 197 into the vertical swivel pins 201 and 203 and thus into the left and right trunnions 161 and 163 which transfer it into left and right clevis members 151 and 153 that are fixed on the back of the blade 3. If the blade 3 encounters a curb or similar obstacle during forward motion of the vehicle 5, the wear strip 141 will be held stationary by such obstacle. The blade 3, however, can pivot on its trunnions 161 and 163 to allow the bottom edge 143 to rise against the resistance of torsion bar 171. When the edge 143 has risen high enough to ride over the obstacle, the spring 173 will return the blade to its operative position. Impact loads upon encountering obstacles are absorbed by the flexible, swivel connections between the blade 3 and side beams 9 and 11, by the rugged H-frame 7 design and pivotal hinge connection with the sturdy tube 81, and by the rack and pinion mechanism with slip clutches as well as by the torsion spring.

As indicated above, it is relatively simple and easy to remove most of the apparatus 1 from the vehicle 5. To do this the two keeper pins 269 at the bottom of lift bracket means 19 are removed so that the floating bracket 265 is ready to be lifted from fixed bracket 251. The two keeper pins 103 are then removed and hinge pins 99 pulled out of the ends of tube 81 thereby releasing the side beams 9 and 11 from the vehicle frame. The floating bracket 265 can then be lifted and detached from the vehicle. For this, the motor 280 may be operated if necessary to increase the length of the linear actuator 17 and mechanically lift the bracket 265 until bottom ends 263 are out of holes 261 in bottom bracket 251. At this point all of the apparatus except bottom bracket 251 and lift tube 81 can be moved away from the vehicle. The hinge pins 99 should be inserted into the ends of the tube 81 into the stowed position as shown at the left in FIG. 7.

Instead of removing most of the apparatus as just described, it is also easy to remove only the blade 3. To do this, the vertical hinge pins 201 and 203 simply are lifted out of the trunnions 161 and 163 and the blade taken off of the ends of the side beam clevis members 195 and 197. The motor 21 can be operated so that the clevis members are equal distances from the front of the vehicle. If desired a bumper travel bar (not shown) across the front comprising, for example, a hollow tube of rectangular cross section with apertured fittings on the back to fit between the upper and lower arms 191 and 193 of clevis members 195 and 197 can be mounted on them by inserting the hinge pins 201 and 203 through the fittings and the clevis members in a manner similar to mounting of the blade 3.

Figure 15:
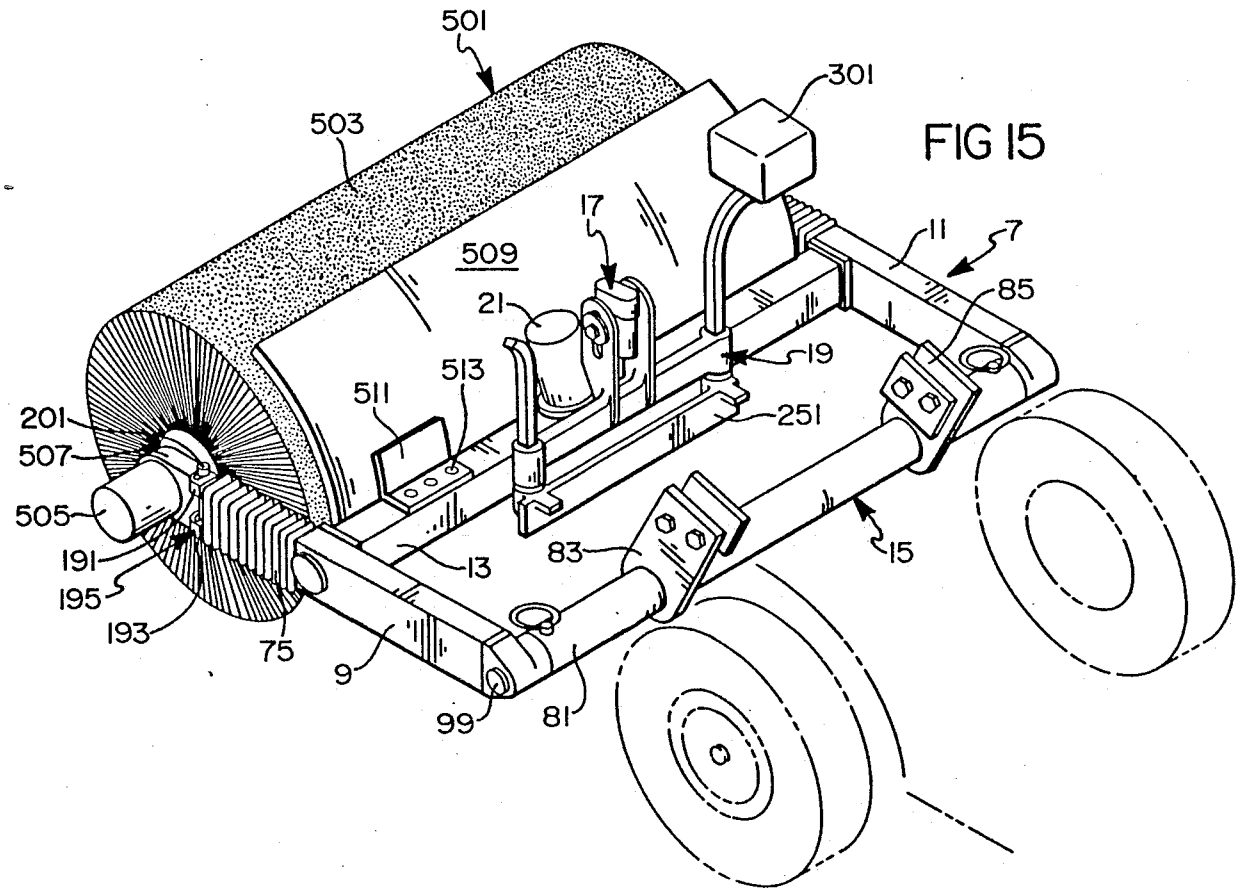
FIG. 15 is a diagramatic perspective view similar to FIG. 4 showing the invention used to support a rotary brush on the front end of a vehicle.

Use of the apparatus of this invention as a means to removably mount snow plow blades on vehicles is expected to be a major application of the invention. However, the H-frame design with parallel side beams 9 and 11 extending in front of cross beam 13 and parallel to the length of the vehicle 5 and having the simple connection means provided by clevis members 195 and 197 and swivel pins 201 and 203 appears to be an optimum arrangement for mounting various implements other than plow blades (such as rotary brushes, gang mowers, vacuum cleaners, etc.) on the front of a vehicle. For example, FIG. 15 shows a rotary brush mechanism 501 mounted on the clevis members at the front ends of side beams 9 and 11. The mechanism 501 has a cylindrical brush 503 that rotates on a horizontal axis provided by a horizontal shaft inside of shaft housing 505. The length of the brush is such that it fits in the space between the side beams 9 and 11 and the cross beam 13. The housing 505 has a rigid fitting 507 at each end that is shaped to fit with and be supported by the upper and lower arms 191 and 193 of the clevis members 195 and 197 and these are apertured (like trunnions 151 and 153) to receive the swivel pins 201 and 203. A curved rear shield plate 509 with bottom angle-shaped mounting brackets 511 may be removably attached by fasteners 513 to the top of cross beam 13 behind the brush 503.

Other applications as well as modifications of the structures described above may be made without departing from the spirit and scope of the invention.

What is claimed is:

1. Apparatus for attaching an implement such as a snow plow blade to the front of a vehicle comprising an implement to extend transversely of the length of a vehicle and be operated by movement of a vehicle, a support frame for operatively attaching the implement to the vehicle, left side connection means on the rear of the implement adjacent the left end of the implement, right side connection means on the rear of the implement adjacent the right end of the implement, said support frame having a left side member extending longitudinally of the vehicle and parallel to the length of the vehicle and connected to said left side connection means, said left side connection means and said right side connection means provide for pivotal movement about substantially vertical axes between the implement and the left and right side members, said support frame having a right side member extending longitudinally of the vehicle and parallel to the length of the vehicle and connected to said right side conneciton means, said support frame including a cross beam in front of the vehicle extending between the side members, pivot means for pivotally mounting the support frame on the front end of a vehicle for pivotal movement that allows the implement to be lifted above the ground and held in such lifted position and that allows the implement to be lowered to the ground, power lift means operatively secured to the cross beam of the support frame for pivoting the frame to lift and lower the implement, rack and pinion length adjusting means for the left and right side members whereby the length adjustment of one of the side members is automatically different than that of the other of the side members to produce angling of the implement, and power angling means mounted on the cross beam of the support frame and operatively connected to the length adjusting means to adjust the lengths of the side members and produce angling of the implement.

2. Apparatus for removably attaching a plow blade or the like to the front of a vehicle comprising a support frame for the plow blade and for operatively attaching it to a vehicle, mounting means at the rear of the support frame for removably mounting it on the front of a vehicle, said support frame having a left side member and a right side member, said side members extending parallel to each other and to the length of the vehicle when the support frame is mounted on the vehicle, said side members having telescopic rack means for telescopically moving the side members, left means for pivotally securing a plow blade to the front of the left side member, right means for pivotally securing a plow blade to the front of the right side member, said support frame having a cross beam extending between and at right angles to the side members, a transverse pinion means in the cross beam and operatively connected at opposite ends to said rack means and actuating means on the cross beam for operating the pinion means to drive the rack means to telescopically move the side members.

3. A plow blade for attachment to a vehicle comprising a moldboard having a bottom edge adapted to scrape the ground, first means for mounting the moldboard on a vechicle, second means for supporting the moldboard on the first means, third means comprising a pivotal connection between the first means and the second means whereby the moldboard is pivotally mounted on the first means, said pivotal connection having a pivot axis extending lengthwise of the moldboard and spaced above and substantially parallel to said bottom edge, and a torsion bar having an axis extending along and coaxial with said pivot axis and having one portion fixed against rotation about said axis relative to said moldboard and another portion fixed against rotation about said bar axis relative to said first means, said torsion bar yieldably resisting pivotal movement of the moldboard and acting with said pivotal connections to provide trip action for the moldboard.

4. Apparatus for removably attaching a plow blade or the like to the front of a vehicle comprising a support frame for the plow blade and for operatively attaching it to a vehicle, mounting means at the rear of the support frame for removably mounting it on the front of a vehicle, said support frame having a left side member and a right side member, said side members extending parallel to each other and to the length of the vehicle when the support frame is mounted on the vehicle, said side members having telescopic rack means for telescopically moving the side members, left means for pivotally securing a plow blade to the front of the left side member, right means for pivotally securing a plow blade to the front of the right side member, and actuating means for operating the rack means to telescopically move the side members, said left and right side members comprising hollow beams, said rack means being at least partially inside of said hollow beams, said support frame including a hollow cross beam extending between and rigid with said side memberbeams, said rack means and said actuating means being at least partially located inside of said cross beam.

5. Apparatus as set forth in claim 4 wherein said actuating means includes an electric motor and clutch means mounted on said cross beam and operatively connected to said rack means.

6. Apparatus as set forth in claim 5 wherein said support frame side members and cross beam are arranged in substantially an H-shape.

7. Apparatus as set forth in claim 4 wherein said mounting means includes pivot means for pivotally mounting the frame on the vehicle for vertical movement, and including lift bracket means for removable attachment to the front of a vehicle, and a linear actuator connected at one end to said lift bracket means and at the other to said cross beam to provide power for vertical movement of the support frame on said pivot means.

8. Apparatus as set forth in claim 7 including a plow blade, said left and right means pivotally securing the plow blade to said side members for pivotal movement about a common axis, said plow blade having a torsion bar located on said axis, first means fixing a portion of said torsion bar against rotation about said axis relative to said left and right means, and second means fixing a portion of said torsion bar against rotation about said axis relative to said side members.

9. Apparatus for removably attaching an implement such as a snow plow blade to the front of a vehicle comprising an implement to extend transversely of the length of a vehicle and be operated by movement of a vehicle, a support frame for operatively attaching the implement to the vehicle, left side connection means on the rear of the implement adjacent the left end of the implement, right side connection means on the rear of the implement adjacent the right end of the implement, said support frame having a left side member extending longitudinally of the vehicle and connected to said left side connection means, said support frame having a right side member extending longitudinally of the vehicle and connected to said right side connection means, pivot means for pivotally mounting the support frame on the front end of a vehicle for pivotal movement that allows the implement to be lifted above the ground and held in such lifted position and that allows the implement to be lowered to the ground, power lift means operatively connnected to the support frame for pivoting the frame to lift and lower the implement, said left and right side connection means including clevis members secured to the implement and trunnion members pivoted on said clevis members, said side members having trunnions fitting with said trunnion members, vertically extending slidably removable swivel pins connecting the trunnions and the trunnion members, said implement comprising a plow blade, the axis of pivot of said trunnion members to said clevis members being parallel to the bottom edge of the plow blade, a torsion bar coaxial with said axis of pivot, means fixing the ends of the torsion bar to said trunnion members, whereby said ends are substantially non-rotatable with respect to said trunnion members, trunnions, and side members, and non-rotatably affixed to a central portion of said torsion bar and connected to said plow blade for pivotal movement with the plow blade about said axis of pivot.

10. Apparatus for removably attaching an implement such as a snow plow blade to the front of a vehicle comprising an implement to extend transversely of the length of a vehicle and be operated by movement of a vehicle, a support frame for operatively attaching the implement to the vehicle, left side connection means on the rear of the implement adjacent the left end of the implement, right side connection means on the rear of the implement adjacent the right end of the implement, said support frame having a left side member extending longitudinally of the vehicle and connected to said left side connection means, said support frame having a right side member extending longitudinally of the vehicle and connected to said right side connection means, pivot means for pivotally mounting the support frame on the front end of a vehicle for pivotal movement that allows the implement to be lifted above the ground and held in such lifted position and that allows the implement to be lowered to the ground, power lift means operatively connected to the support frame for pivoting the frame to lift and lower the implement, said pivot means comprising a pivot tube having bracket means for securing it to the front of a vehicle, said pivot means including left and right hinge pins removably fitting in the left and right ends of the pivot tube, removable latch means for selectively holding the hinge pins in stowed postions inside the tube and operative positions wherein they partially extend outwardly from the ends of the tube, said support frame having left and right bearings at the rear ends of the left and right side members sized to be mounted on said hinge pins when said hinge pins are in the operative positions whereby said support frame is pivotally supported on said pivot tube and transfers load into the pivot tube.

11. Apparatus for removably attaching an implement such as a snow plow blade to the front of a vehicle comprising an implement to extend transversely of the length of a vehicle and be operated by movement of a vehicle, a support frame for operatively attaching the implement to the vehicle, left side connection means on the rear of the implement adjacent the left end of the implement, right side connection means on the rear of the implement adjacent the right end of the implement, said support frame having a left side member extending longitudinally of the vehicle and connected to said left side connection means, said support frame having a right side memeber extending longitudinally of the vehicle and connected to said right side connection means, pivot means for pivotally mounting the support frame on the front end of a vehicle for pivotal movement that allows the implement to be lifted above the ground and held in such lifted position and that allows the implement to be lowered to the ground, power lift means operatively connected to the support frame for pivoting the frame to lift and lower the implement, said left and right side connection means including clevis members secured to the implement and trunnion members pivoted on said clevis members, said side members having trunnions fitting with said trunnion members, vertically extending slidably removable swivel pins connecting the trunnions and the trunnion members, mounting means for the support frame for pivotally attaching it to the front of a vehicle, said mounting means including a slidably removable left horizontally extending hinge pin for pivotally mounting the left side member, said mounting means including a slidably removable horizontally extending right hinge pin for pivotally mounting the right side member lift mounting bracket means having a lower bracket for attachment to the front of a vehicle, said lower bracket having a pair of vertical legs, said lift mounting bracket means including a floating bracket slidably and removably mounted on said legs and resting on said lower bracket, said power lift means being supported on said floating bracket.

12. Apparatus for removably attaching an implement such as a snow plow blade to the front of a vehicle comprising an implement to extend transversely of the length of a vehicle and be operated by movement of a vehicle, a support frame for operatively attaching the implement to the vehicle, left side connection means on the rear of the implement adjacent the left end of the implement, right side connection means on the rear of the implement adjacent the right end of the implement, said support frame having a left side member extending longitudinally of the vehicle and connected to said left side connection means, said support frame having a right side member extending longitudinally of the vehicle and connected to said right side connection means, pivot means for pivotally mounting the support frame on the front end of a vehicle for pivotal movement that allows the implement to be lifted above the ground and held in such lifted position and that allows the implement to be lowered to the ground, power lift means operatively connected to the support frame for pivoting the frame to lift and lower the implement, a lift mounting bracket means having a lower bracket for attachment to the front of a vehicle, said lower bracket having a pair of vertical legs, said means including a floating bracket slidably and removably mounted on said lower bracket, said power lift means being supported on said floating bracket.

13. Apparatus as set forth in claim 12 wherein said support frame is H-shaped and has a cross member extending between and rigid with the side members, said power lift means being operatively connected to said cross member.

14. Apparatus as set forth in claim 13 wherein said pivot means includes a pivot tube for attachment to the front of a vehicle and left and right slidably removable horizontally extending hinge pins fitting in the ends of the pivot tube and extending through apertures in the rear of the left and right side members for pivotally attaching them to the pivot tube.

15. Apparatus as set forth in claim 14 wherein said left and right side members are telescopic to provide for angling of the implement.

16. Apparatus as set forth in cliam 15 including power angling means mounted on said cross member and operatively connected to said left and right members to produce telescopic movement thereof.

17. Apparatus for removably attaching an implement such as a snow plow blade to the front of a vehicle comprising an implement to extend transversly of the length of a vehicle and be operated by movement of the vehicle, and H-shaped support frame for operatively attaching the implement to the vehicle, said support frame having a left side member and a right side member extending parallel to each other and to the length of the vehicle and a cross beam extending between the left and right side members and at substantilly right angles to them, left side connection means on the rear of the implement adjacent the left end of the implement, right side connection means on the rear of the implement adjacent the right end of the implement, said left and right side connection means including clevis members secured to the implement and trunnion members pivoted on the clevis members, said left and right side members having trunnions fitting respectively with the trunnion members of said left and right connection means, left and right vertically extending swivel pins respectively connecting the trunnions and the trunnion members, said swivel pins being manually, slidable in and out of the trunnions and trunnion members to provide a means for manually connecting and disconnecting the implement and the support frame. pg,41

18. Apparatus as set forth in claim 17 including torsion bar means on the back of the implement and secured to it and to the connection means to yieldably resist tip-up of the implement when it encounters an obstacle.

19. Apparatus as set forth in claim 18 wherein the trunnions and trunnion members provide the only load transmitting connection between the implement and the frame and vehicle.

20. Apparatus as set forth in claim 17 including mounting means for the support frame for pivotally attaching it to the front of a vehicle for pivotal up and down movement about a horizontal axis, said mounting means including a left horizontally extending hinge pin for pivotally mounting the left side member to the vehicle and a right horizontally extending hinge pin for pivotally mounting the right side member to the vehicle, said hinge pins being slidable in and out of their mounting on the vehicle to provide means for manually connecting and disconnecting the support frame and the vehicle.

* * * * *